United States Patent [19]

Hoaki

[11] Patent Number: 4,900,198

[45] Date of Patent: Feb. 13, 1990

[54] METHOD AND APPARATUS FOR REMOVING OLD PILE

[75] Inventor: Kouji Hoaki, Tokyo, Japan

[73] Assignees: Seisan Gijutsu Center Co., Ltd.; NKS Corporation, Tokyo, Japan

[21] Appl. No.: 277,938

[22] Filed: Nov. 30, 1988

[30] Foreign Application Priority Data

| | | | |
|---|---|---|---|
| Dec. 1, 1987 | [JP] | Japan | 62-301463 |
| Feb. 13, 1988 | [JP] | Japan | 63-30080 |
| Feb. 13, 1988 | [JP] | Japan | 63-30081 |

[51] Int. Cl.[4] ..... E02D 5/00

[52] U.S. Cl. ..... 405/303; 83/177; 51/241 S; 405/232; 405/229

[58] Field of Search ..... 405/232, 224, 227, 195, 405/228; 83/15, 16, 22, 177, 431, 57, 53; 51/241 S, 410; 166/54.5, 55, 55.1, 55.6; 37/2 R; 404/90

[56] References Cited

U.S. PATENT DOCUMENTS

| | | | |
|---|---|---|---|
| 3,985,848 | 10/1976 | Frische et al. | 83/177 X |
| 4,435,902 | 3/1984 | Mercer et al. | 83/53 X |
| 4,619,556 | 10/1986 | Parra | 405/232 X |
| 4,683,684 | 8/1987 | Yie | 51/410 X |
| 4,761,039 | 8/1988 | Hilaris | 404/90 X |
| 4,808,037 | 2/1989 | Wade et al. | 405/227 X |

*Primary Examiner*—Dennis L. Taylor

*Attorney, Agent, or Firm*—Oblon, Spivak, McClelland, Maier & Neustadt

[57] ABSTRACT

A bucket is set to surround an upper end portion of an old pile, and an intermediate portion of the pile is radially cut by jetting high pressure water from the bucket from the center and opposite sides of the outer periphery of the old pile. The pile portion above the cut portion is chucked with a chuck mechanism, and in this state the chuck mechanism is turned to twistingly sever the pile portion above the cut portion with the stress thus produced, and the separated pile portion is removed. The above sequence of operations is repeatedly performed to remove the entire old pile.

7 Claims, 24 Drawing Sheets

METHOD AND APPARATUS FOR REMOVING OLD PILE

BACKGROUND OF THE INVENTION

1. Field of the Invention

This invention relates to a method and apparatus for removing old and unneeded piles embedded in the ground.

2. Prior Art Statement

As is well known in the art, a number of piles are driven into the ground in constructing a foundation of a building or for similar purposes.

However, when a new building is to be constructed after dismantling an old building, for example, the old piles are frequently an obstruction and have to be removed.

Usually, new buildings are larger and higher than oil buildings. Therefore, the old piles cannot sufficiently support the new building. If old piles were to be utilized as support piles for a new building, they would be of little value and would rather be dangerous because their strength has generally deteriorated due to long use of the concrete and reinforcing bars constituting them.

Heretofore, comparatively small-scale old piles could be removed by digging the ground surrounding them or pulling them by using machines. However, it has sometimes been impossible to remove large piles, or the large-scale piles could be removed only gradually over a long period of time by using a very large machine.

When it is impossible to remove the old piles, the new piles have to be driven in positions other than those occupied by the old ones. This requires an alteration in the design of the entire building, which leads to a great economic loss.

OBJECT AND SUMMARY OF THE INVENTION

An object of the invention is to provide a method and apparatus for readily removing large old piles embedded in the ground.

Another object of the invention is to provide a method and apparatus for removing an old pile while simultaneously digging a pile bore for a new pile.

To attain the above objects of the invention, a bucket is set to surround an upper end portion of an old pile, an intermediate portion of the old pile is radially cut by jetting high pressure water from the bucket from the center and opposite sides of the outer periphery of the old pile. Then, the pile portion above the cut portion is chucked with a chuck mechanism, and in this state the chuck mechanism is turned to twistingly sever the pile portion above the cut portion with the resultant stress. The above sequence of operations is repeated to thereby remove the entire old pile.

According to the invention, an old pile embedded in the ground can be removed readily, efficiently and progressively from an upper portion by radially cutting an intermediate portion of the old pile with high pressure water and twistingly severing the pile portion above the cut portion with a chuck mechanism. Besides, since the old pile is cut with high pressure water, there are no noise or vibration problems, and the pile removal operation can be performed even in residential or urban areas. Further, by providing a digging means at the lower end of the bucket, the removal of the old pile and expansion of the pile bore can be effected simultaneously. Further, by making the diameter of the expanded pile bore coincident with the diameter of a pile to be newly installed, the pile bore of the old pile can be used as the pile bore of the new pile.

The above and other objects and features of the invention will become more apparent from the following detailed description with reference to the accompanying drawings.

BRIEF DESCRIPTION OF THE DRAWINGS

FIG. 31 is a sectional view showing a fifth embodiment of the apparatus for removing an old pile according to the invention.

DETAILED DESCRIPTION OF THE PREFERRED EMBODIMENTS

Figure 1:
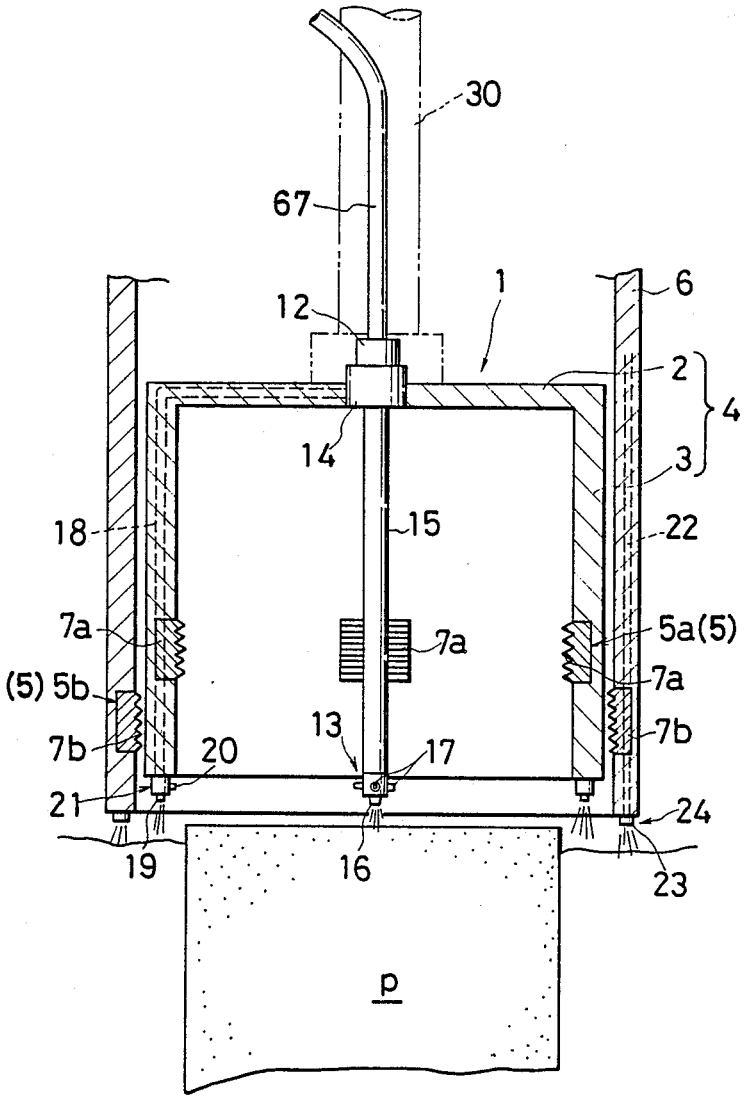
FIG. 1 is a schematic sectional view showing a first embodiment of the apparatus for removing an old pile according to the invention.

FIGS. 1 to 12 show a first embodiment of the apparatus for removing an old pile according to the invention. The apparatus, generally designated at 1, for removing an old pile substantially comprises a bucket 4 having a disk-like top 2 and a cylindrical peripheral wall 3 depending from the edge of the top 2 and open at the bottom. The bucket 4 is provided with a chuck mechanism 5, and a casing 6 is fitted on the bucket 4.

Figure 3:
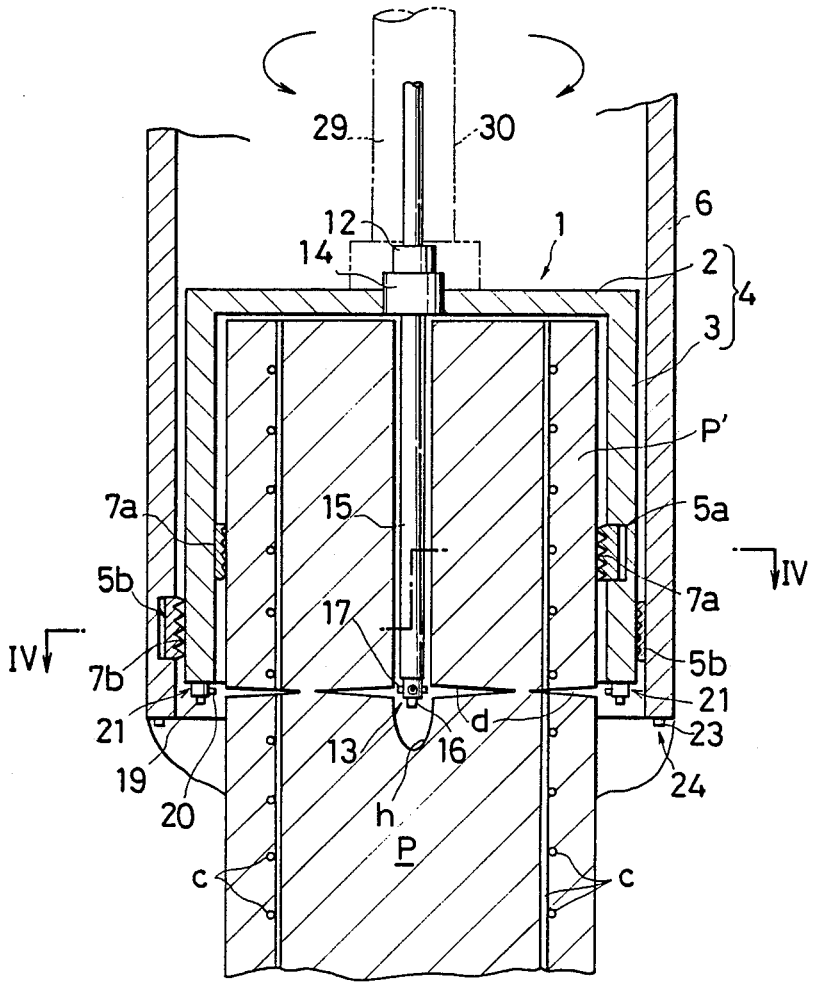
FIG. 3 is a sectional view showing the apparatus of FIG. 1 with a chuck mechanism in an operating state after the old pile is cut.
Figure 4:
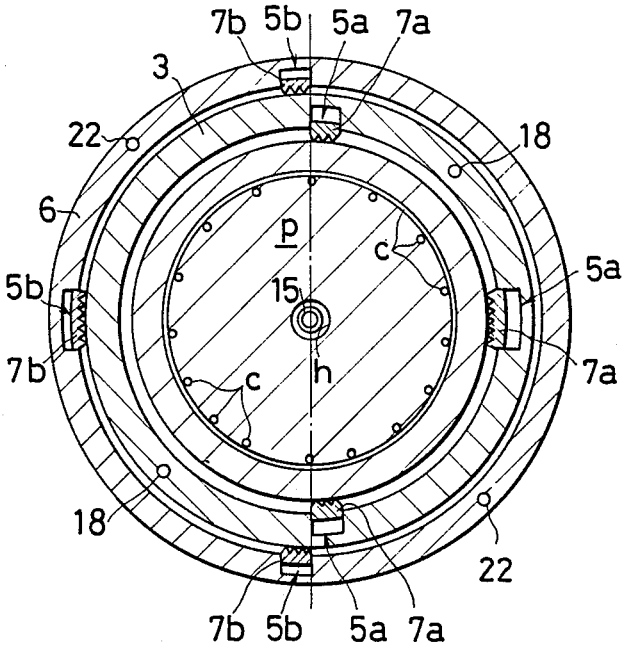
FIG. 4 is a sectional view taken along line IV—IV in FIG. 3.

In an example shown in FIGS. 3 and 4, the chuck mechanism 5 includes first chucks 5*a* provided on the inner periphery of the peripheral wall 3 of the bucket 4 for chucking an old pile P and second chucks 5*b* provided on the inner periphery of the casing 6 for chucking the bucket 4.

As shown in FIG. 4, the first chucks 5*a* are provided on the bucket inner periphery at an interval of 90 degrees. Each first chuck includes a first urging member 7*a*. To chuck the pile P, the individual urging members 7*a* are urged against the pile outer periphery by a hydraulic or like piston-cylinder mechanism (not shown). When the first chucks are not used, the first urging members 7*a* may be accommodated in the peripheral wall 3.

The second chucks 5*b* are provided on the inner periphery of the casing 6 and include respective second urging members 7*b* which are circumferentially spaced apart to have the same phases as the first chucks. The second urging members 7*b* are normally accommodated in the casing 6. They can be driven by a piston-cylinder mechanism (not shown) to project inwardly in four different directions so that their inner surfaces are urged against the outer periphery of the bucket 4, thus securing the bucket 4 and casing 6 to each other.

Figure 6:
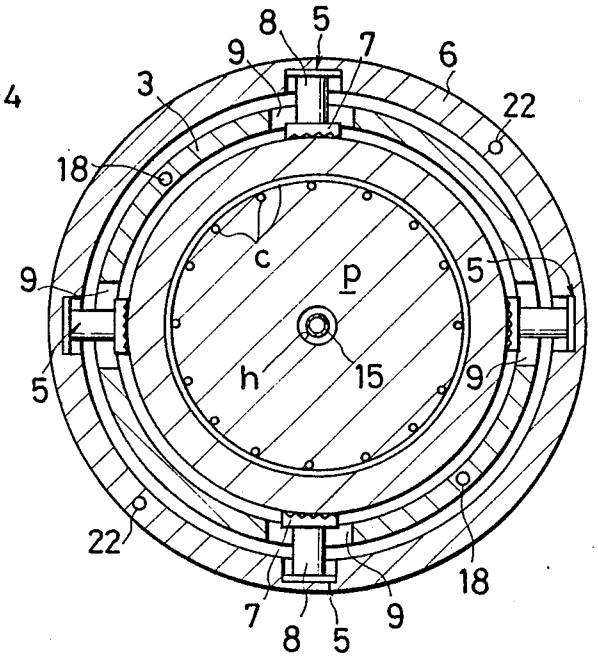
FIG. 6 is a sectional view taken along line VI—VI in FIG. 5.
Figure 5:
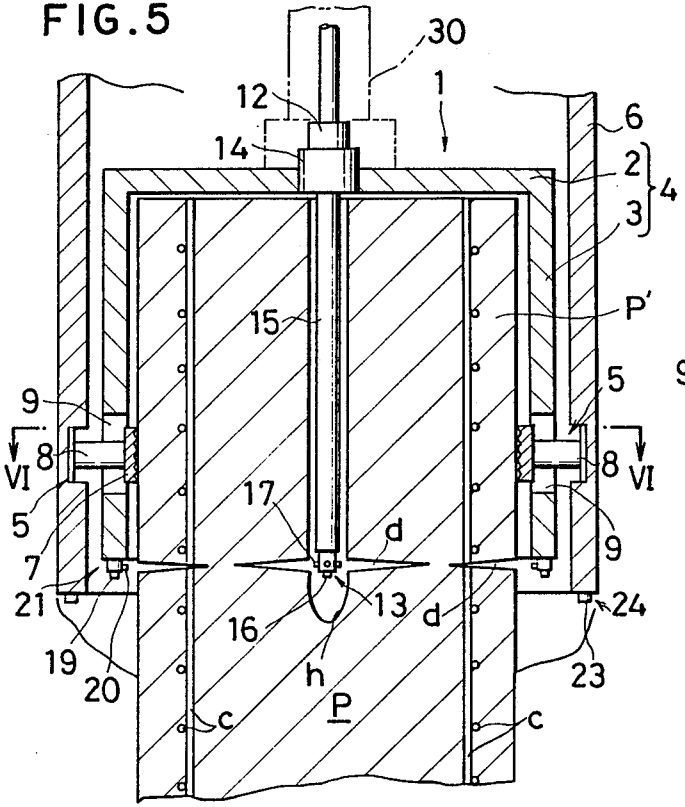
FIG. 5 is a sectional view showing an old pile removal apparatus with a different chuck mechanism.

FIGS. 5 and 6 show a different example of the chuck mechanism 5. In this example, the urging members 7 are each provided on the casing 6 via a piston-cylinder mechanism 8. As in the preceding example, the piston-cylinder mechanisms 8 are driven hydraulically to be elongated and contracted. In their contracted state, the urging members 7 are accommodated in the casing 6 to be flush with the casing inner periphery. In their extended state, the urging members 7 are urged against the outer periphery of an old pile P in four directions through through holes 9 formed in the peripheral wall 3 of the bucket 4, thus securing the casing 6 and pile P to each other. In this case, the alignment of the urging members 7 and through holes 9 is necessary. However, the chuck mechanism 5 is simplified in structure, so that it can be manufactured inexpensively.

Figure 8:
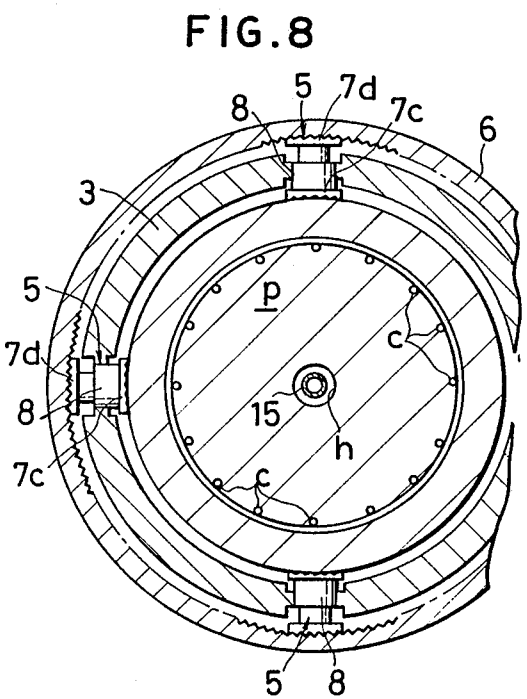
FIG. 8 is a sectional view taken along line VIII—VIII in FIG. 7.
Figure 7:
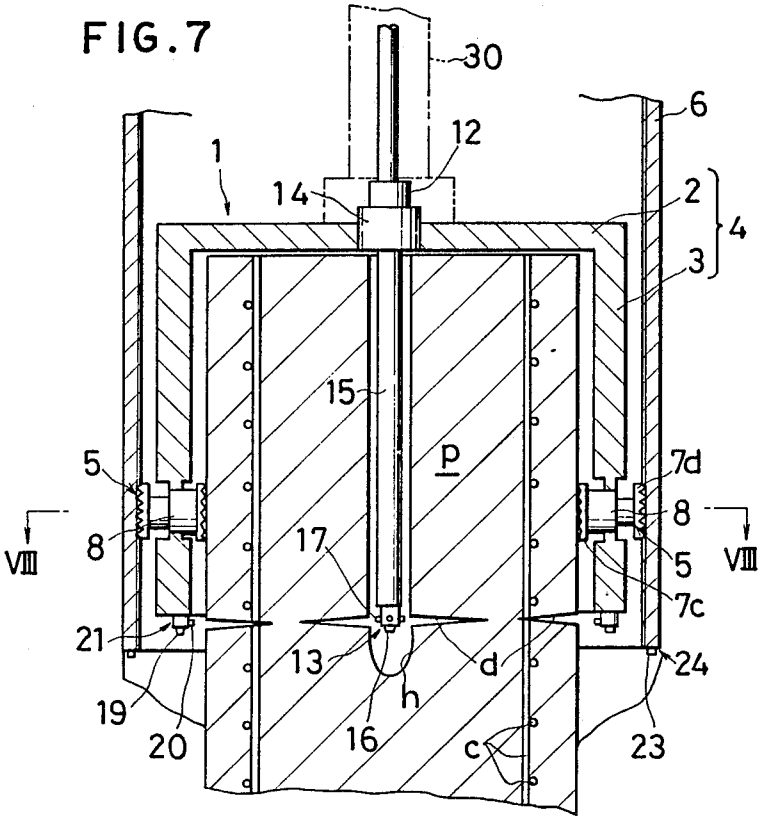
FIG. 7 is a sectional view showing an old pile removal apparatus with a further chuck mechanism.

FIGS. 7 and 8 show a further example of the chuck mechanism 5. In this example, the chuck mechanism 5 is provided in the bucket 4. The piston-cylinder mechanisms 8 are each capable of elongation and contraction in both the inner and outer directions. Each piston-cylinder mechanism 8 has urging members 7*c* and 7*d* projecting from the opposite ends. Thus, the inner surface of the inwardly projecting urging member 7*c* is urged against the outer periphery of an old pile P, while the outwardly projecting urging member 7*d* is urged against the inner surface of the casing 6, thus securing the pile P and casing 6 to each other.

Figure 9:
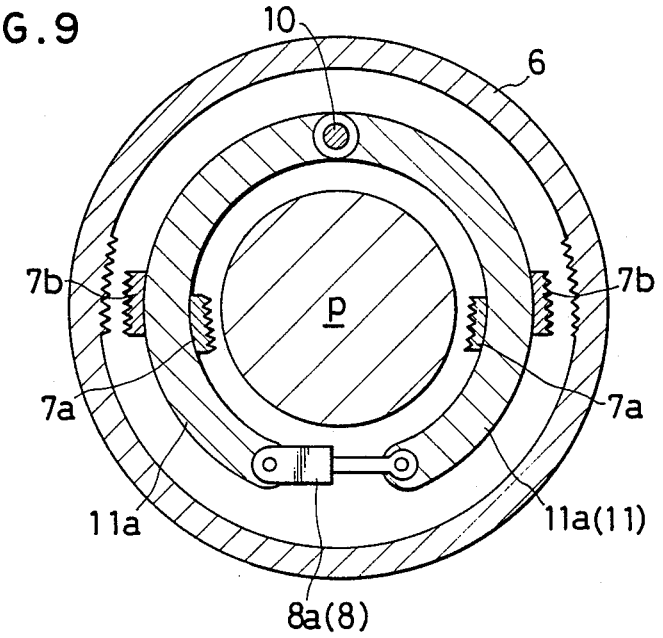
FIG. 9 is a sectional view showing a still further chuck mechanism.
Figure 10:
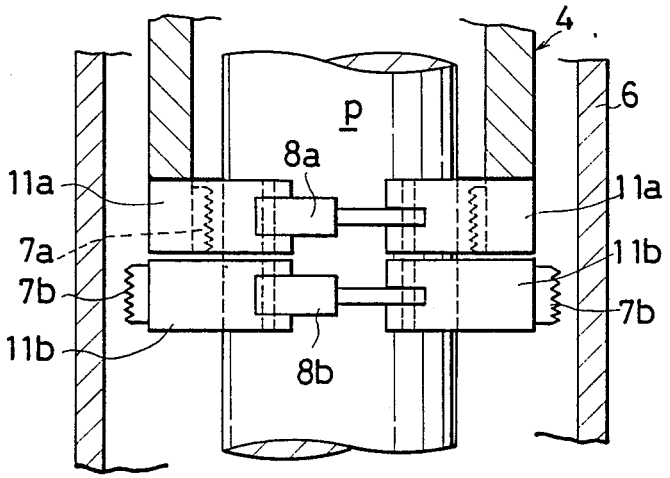
FIG. 10 is an axial sectional view showing the chuck mechanism shown in FIG. 9.

FIGS. 9 and 10 show a still further example of the chuck mechanism 5. This chuck mechanism 5 includes a support shaft 10 downwardly extending from the lower end of the bucket 4, a pair of arcuate operating rods 11 having urging members 7*a* and 7*b* and each having one end rotatably mounted on the support shaft 10, and a piston-cylinder mechanism 8 provided on the free end of one of the operating rods 11. In this case, two pairs of operating rods 11 and associated piston-cylinder mechanisms 8 are provided side by side in the vertical direction. For example, the piston-cylinder mechanism 8*a* is constructed so as to cause contraction of the upper pair of operating rods 11*a*, and the other piston-cylinder mechanism 8*b* is constructed so as to cause expansion of the lower pair of operating rods 11*b*. Thus, by operating the piston-cylinder mechanisms 8*a* and 8*b*, an old pile P is chucked by the urging members 7*a* provided on the upper pair of operating rods 11*a*, and the casing 6 is chucked by the urging members 7*b* of the lower pair of operating rods 11*b*. Thus, the casing 6, bucket 4 and pile P can be secured to one another.

The contact surfaces of the urging members 7 may be formed with fine antiskid irregularities.

In the apparatus 1 illustrated, a swivel joint 12 is provided on the center of the top 2 of the bucket 4. The swivel joint 12 has a downwardly depending first high pressure water jet unit 13. The unit 13 includes a high pressure water pipe 15 depending from the swivel joint 12 via a packer 14 and a downwardly directed high pressure water jet nozzle 16 and horizontally directed high pressure water jet nozzles 17, the nozzles 16 and 17 being provided on the lower end of the pipe 15. The peripheral wall 3 of the bucket 4 is provided with diametrically opposed second high pressure water jet units 21. Each second high pressure water jet unit 21 includes a vertical high pressure water passage 18 extending through the wall 3, a downwardly directed high pressure water jet nozzle 19 and a horizontally inwardly directed high pressure water jet nozzle 20, the nozzles 19 and 20 being provided at the lower end of the high pressure water passage 18. The horizontally directed high pressure water jet nozzles 17 of the first high pressure water jet unit 13 is located at the center of the open bottom of the bucket 4 and at the same level as the high pressure water jet nozzles 20 of the second high pressure water jet units 21.

The casing 6 is also provided with diametrically opposed third high pressure water jet units 24. Each third high pressure water jet unit 24 includes a vertical high pressure water passage 22 extending through the casing 6 and open at the lower end thereof and a high pressure water jet nozzle 23 provided at the lower end of the passage 22 for downwardly jetting high pressure water.

Now, the method of removing an old and unneeded pile embedded in the ground with the first embodiment of the old pile removal apparatus having the above construction according to the invention will now be described.

Figure 11:
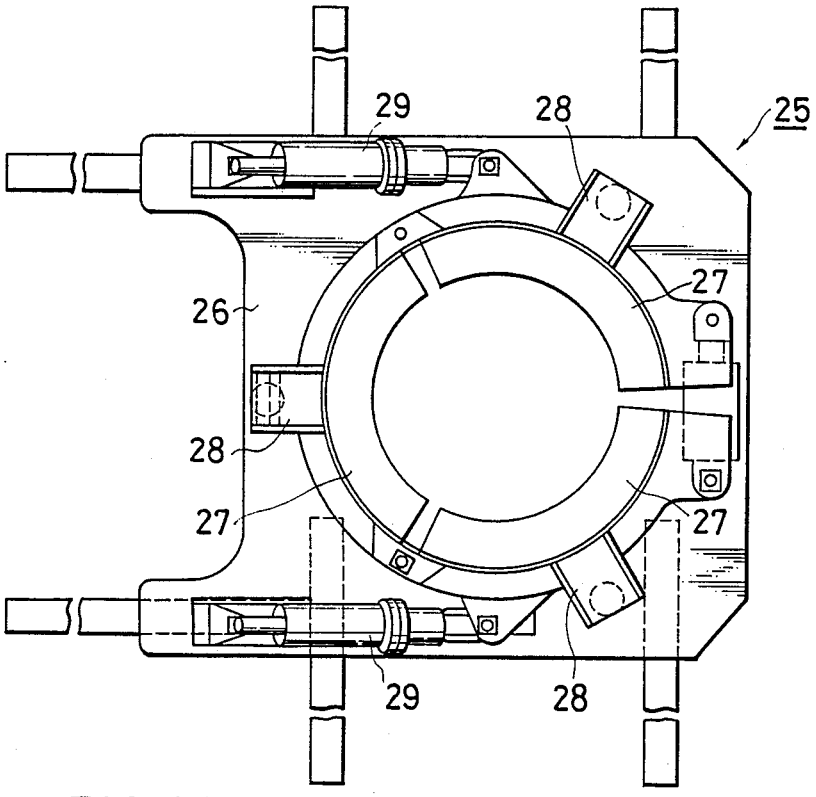
FIG. 11 is a plan view showing an embodiment of the setting unit.
Figure 12:
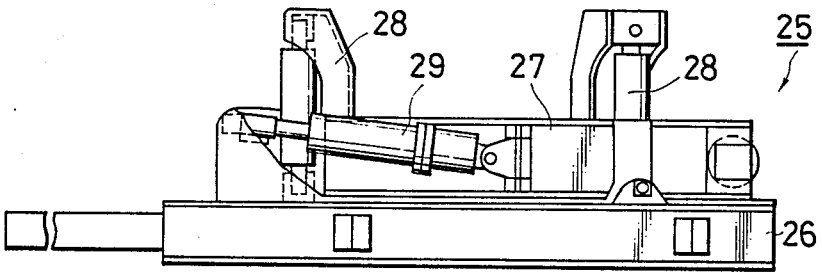
FIG. 12 is a front view showing the setting unit shown in FIG. 11.

First, the casing 6 is set by operating a setting unit 25 such that it surrounds an upper end portion of the pile P. The setting unit 25 is shown in FIGS. 11 and 12. As is shown, the setting unit 25 includes a base 26, in which are provided a contractible chuck 27, jacks 28 supporting and capable of vertically displacing the chuck 27 and swinging mechanisms 29 for swinging the jacks 28. The casing 6 is chucked in the chuck 27 of the setting unit 25 and is set in an operating position by operating the jacks 28 and swinging mechanisms 29 to surround an upper end portion of a sufficient length or vertical dimension. At this time, if the casing 6 is provided with the third high pressure water jet units 24, it is advanced into the ground by digging out the earth under its lower end by downwardly jetting high pressure water from the high pressure water jet nozzles 23.

A post 30 of a machine, such as the kelley-bar of an earth drill, is connected to the center of the upper surface of the top 2 of the bucket 4, and the bucket 4 is then suspended from a crane (not shown) via a wire or wires. Also, high pressure water hoses 67 are connected respectively to the high pressure water pipe 15 and high pressure water passages 18 and 22 of the respective high pressure water jet units 13, 21 and 24 at the swivel joint 12. The high pressure water hoses have their other ends coupled to an ultra-high pressure water jet unit (not shown), which can control supply of jet water to each of the high pressure water jet nozzles 16, 17, 19, 20 and 23 of the high pressure water jet units 13, 21 and 24. Further, an oil pressure hose extending from an oil pressure mechanism (not shown) is connected to each of the piston-cylinder mechanisms 8 of the chuck mechanism 5.

The ultra-high pressure water jet unit noted above preferably is able to discharge water under a maximum pressure of 3,800 kg/cm at a maximum rate of 86 litres/-min. In this case, water under an extremely high pressure is jetted from the high pressure water jet nozzles 16, 17, 19, 20 and 23 of the high pressure water jet units 13, 21 and 24, so that it is possible to sever concrete and reinforcing bars c.

When the casing 6 has been advanced into the ground to the intended depth, the bucket 4 suspended in the air is lowered slowly into the casing 6 while turning it in alternate, i.e., normal and reverse, directions every 180 degrees, for instance, and at the same time high pressure water containing fine abrasive particles is jetted downwardly from the high pressure water jet nozzles 16 and 19 of the first and second high pressure water jet units 13 and 21.

As the high pressure water is jetted from the high pressure water jet nozzles 16 and 19 while turning the bucket 4 in alternately opposite directions and slowly lowering it, a vertical bore h is gradually formed from the center of the top of the pile P by the pressure of the high pressure water from the nozzle 16, so that the first high pressure water jet unit 13 is gradually inserted into the vertical bore h, and also an annular groove is formed under the bucket 4 by the pressure of the high pressure water from the nozzle 19, so that the bucket 4 is gradually lowered into the ground. Thus, the bucket 4 progressively surrounds the upper end portion of the pile P until the packer 14 rests on the top of the pile P.

Figure 2:
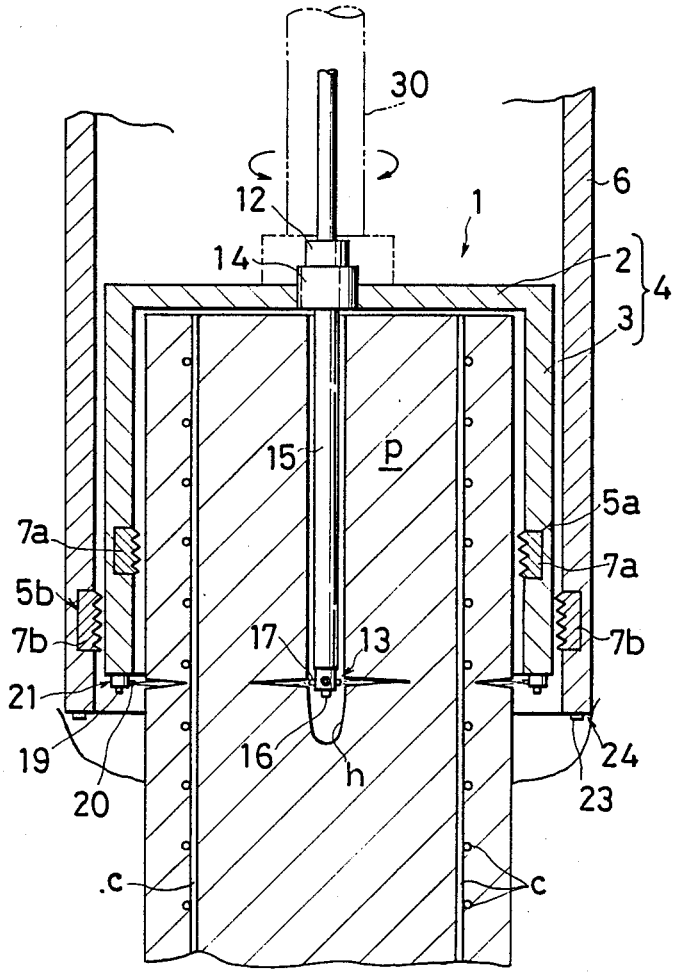
FIG. 2 is a sectional view showing the apparatus of FIG. 1 in a state of cutting an old pile.

At this time, the jetting of high pressure water from the high pressure water jet nozzles 16 and 19 is stopped, and high pressure water including fine abrasive particles is jetted from the horizontally directed high pressure water jet nozzles 17 and 20 of the first and second high pressure water jet units 13 and 21 (FIG. 2). The high pressure water jetted from the high pressure water jet nozzles 17 horizontally cuts the pile P from the center thereof toward the outer periphery, while high pressure water jetted from the high pressure water jet nozzles 20 horizontally cut the pile P together with reinforcing bars c from the outer periphery toward the center of the pile.

If the pile P cannot be sufficiently cut horizontally by the above operation, the upper open end of the vertical bore h formed centrally of the pile by the first high pressure water jet unit 13 is sealed with the packer 14, and high pressure water is jetted from the high pressure water jet nozzles 16 and 17 to increase the pressure in the cut space of the pile P with water. In this way, the concrete portion that has not been cut is cut. When the pile P is sufficiently cut radially with the high pressure water jet nozzles 17 and 20 of the first and second high pressure water jet units 13 and 21, the jetting of the high pressure water from the nozzles 17 and 20 is stopped, and the first and second chucks **5*a* and 5*b* are contracted by operating the first and second piston-cylinder mechanisms, thus strongly securing the outer periphery of the portion P' of the pile P above the cut section d to the bucket 4 by the first chucks 5*a* and securing the bucket 4 to the casing 6 by the second chucks 5*b***.

In this state, the casing 6 is swung by operating the setting unit 25 to cause swinging of the first and second chucks **5*a* and 5*b* together with the casing 6. The pile P, however, is not swung. Therefore, a stress produced by the swinging of the casing 6** acts on the upper end portion P' of the pile P to twist the pile portion left uncut by the high pressure water, thus severing the portion P' of the pile above the cut section d.

When the pile portion above the cutting section is completely severed by the above operation, the swinging of the setting unit 5 is stopped, and the casing 6 is removed from the outer periphery of the bucket 4 by expanding the second chucks **5*b* by operating the piston-cylinder mechanism 8. Then, the bucket 4 is raised together with the severed upper end portion P' of the pile P held clamped between the first chucks 5*a* in the contracted state. In this way, the severed upper end portion of the pile P can be raised with the bucket 4** and removed.

After the severed pile upper end portion is removed, the casing 6 is lowered by the setting unit 25 to surround a new upper end portion of the remaining pile P, the bucket 4 is also lowered to surround the new pile upper end portion, and the new pile upper end portion which has a length substantially corresponding to the height of the bucket 4 is severed and removed by the same sequence of operations as described above. By repeating the above sequence of operations, the entire length of the pile can be removed from the ground.

FIGS. 13 to 23 show a second embodiment of the apparatus for removing a pile with self-turning means for causing the bucket to rotate itself. The apparatus generally designated at 31 comprises a bucket 34 open at the lower end and having a disk-like top 32 and a cylindrical wall 33 depending from the edge of the top 32. A cylindrical rotary frame 35 is provided on an upper portion of the inner wall surface of the bucket 34. An internal swinging gear 36 is secured to the upper end of the inner wall surface of the rotary frame 35. A first chuck mechanism 37 is provided on the inner wall surface of the rotary frame 35 below the swinging gear 36 such that it is rotatable in unison with the rotary frame 35. A second chuck mechanism 38 is provided integrally with the inner wall surface of the bucket 34 below the rotary frame 35.

Two diametrically opposite oil pressure motors 39 with reduction gear are mounted on the upper surface of the top 32 of the bucket 34. Each oil pressure motor 39 has a downwardly extending shaft 40 penetrating the top 32 of the bucket 34 into the bucket 34. To the free end of the shaft 40 is secured a drive gear 41 in mesh with the swinging gear 36. The rotary frame 35 and first chuck mechanism 37 are rotatably supported by a shelf member 42 provided on a vertically intermediate portion of the inner wall surface of the cylindrical wall 33 such that the rotary member 35 and first chuck mechanism 37 are rotatable with respect to the cylindrical wall 33.

Figure 20:
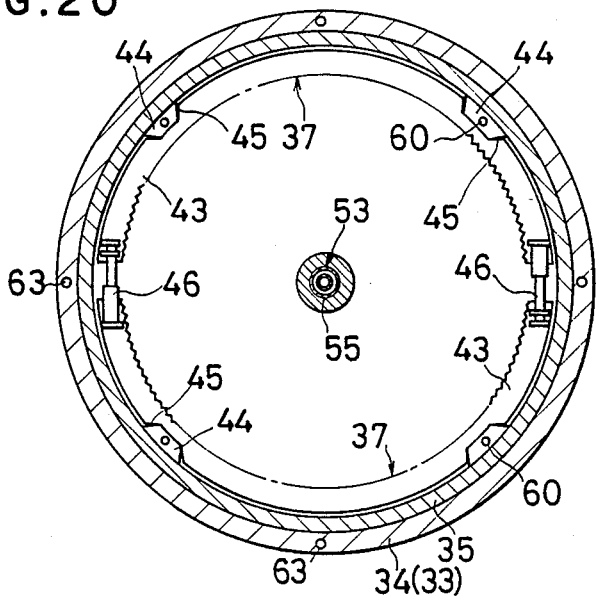
FIG. 20 is a sectional view taken along line XX—XX in FIG. 13.
Figure 21:
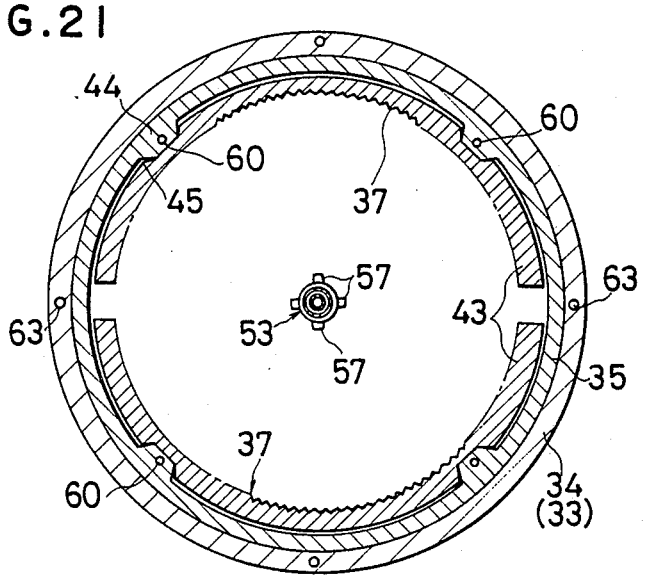
FIG. 21 is a sectional view taken along line XXI—XXI in FIG. 13.

As shown in FIGS. 20 and 21, the first chuck mechanism 37 includes a pair of semicircular chuck frames 43 obtained by axially bisecting a cylindrical member. The chuck frames 43 each has its inner surface formed with fine antiskid irregularities. The rotary frame 35 has its inner surface provided with a plurality of axial ridges 44, and the chuck frames 43 have their outer surfaces formed with axial grooves 45 corresponding in position to and receiving the axial ridges 44. The first chuck mechanism 37 thus can be rotated together with the rotary frame 35 by the engagement between the axial ridges 44 and the axial grooves 45 irrespective of whether it is in a contracted or expanded state. The upper edge of the first chuck mechanism 37 is provided with piston-cylinder mechanisms 46 between the two chuck frames 43 to cause expansion and contraction of the inner space of the first chuck mechanism.

Figure 22:
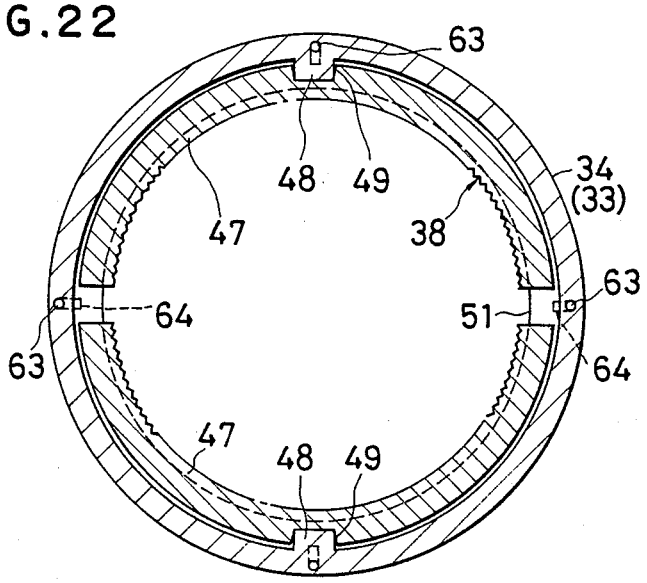
FIG. 22 is a sectional view taken along line XXII—XXII in FIG. 13.
Figure 23:
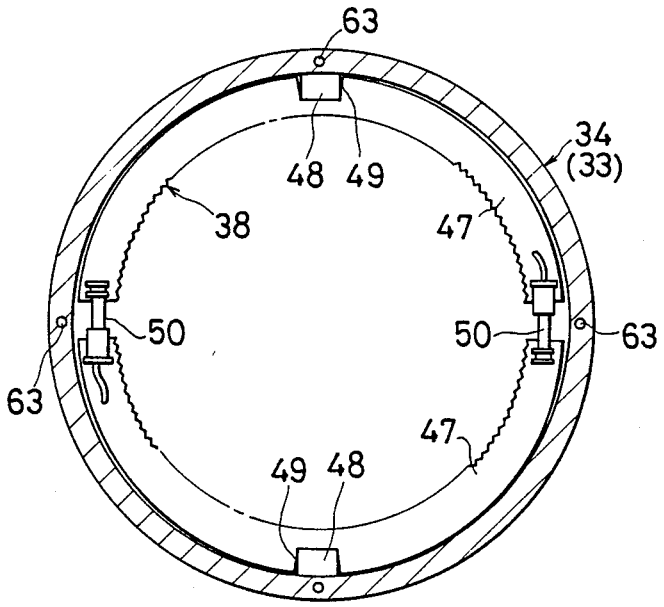
FIG. 23 is a sectional view taken along line XXIII—XXIII in FIG. 13.
Figure 24:
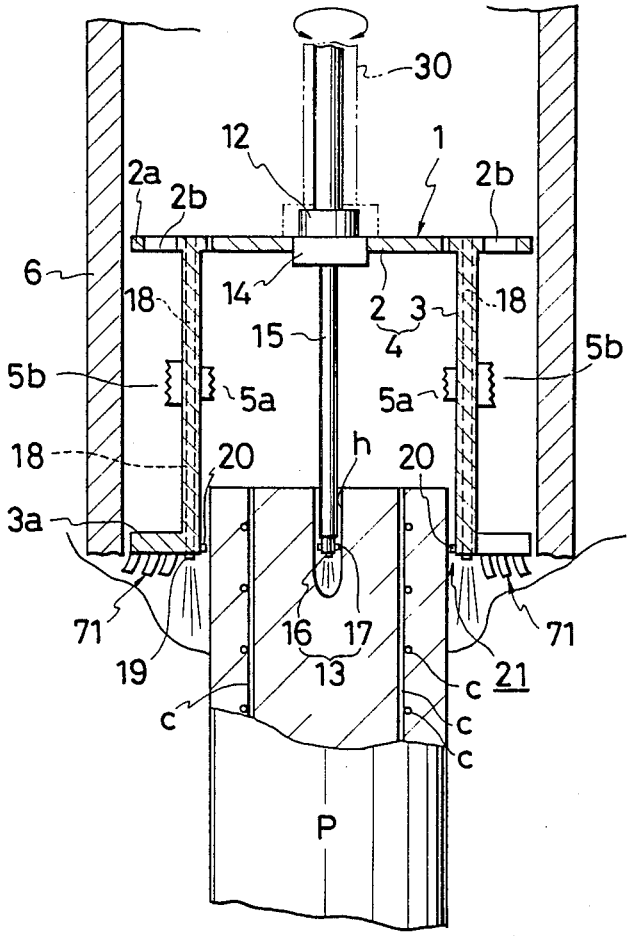
FIG. 24 is a sectional view showing a third embodiment of the apparatus for removing an old pile according to the invention.
Figure 25:
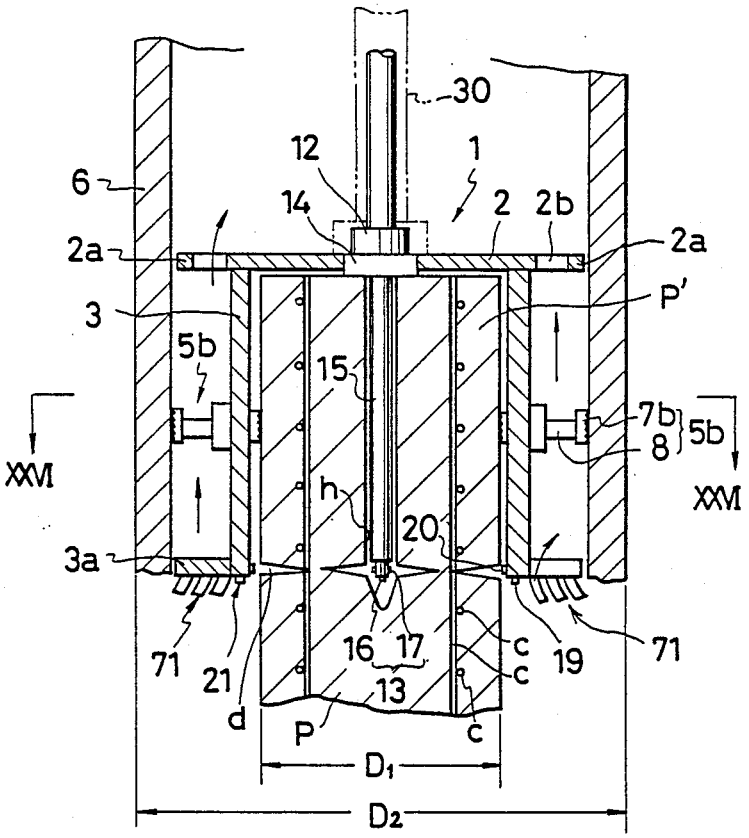
FIG. 25 is a sectional view showing the apparatus of FIG. 24 in a state of being set on top of an old pile.

The second chuck mechanism 38 has substantially the same construction as the first chuck mechanism 37. As shown in FIGS. 22 and 23, it includes a pair of semicircular frames 47 obtained by axially bisecting the cylindrical member. The chuck frames 47 each has its inner surface formed with fine antiskid irregularities. The cylindrical wall 33 has its inner surface formed with a plurality of axial ridges 48, and the chuck frames 47 have their outer surface formed with vertical grooves 49 corresponding to and receiving the axial ridges 48. The second chuck mechanism 38 thus can be rotated together with the peripheral wall 33 with the engagement between the axial ridges 48 and the vertical grooves 49 irrespective of whether it is in an expanded or contracted state. The second chuck mechanism 38 has its upper edge provided with piston-cylinder mechanisms 50 between the chuck frames 47 to cause expansion and contraction of the inner space of the second chuck mechanism and also has its lower edge received on an annular support 51 formed on the lower edge of the cylindrical wall 33.

A swivel joint 52 is provided on the center of the top 32 of the bucket 34, and a first high pressure water jet unit 53 is provided such that it extends downwardly from the swivel joint 52. The first high pressure water jet unit 53 includes a high pressure water pipe 55 depending downwardly from the swivel joint 52 via a packer 54, a downwardly directed high pressure water jet nozzle 56 and horizontally directed high pressure water jet nozzles 57 provided at the lower open end of the pipe 55.

The bucket 34 is provided with a second high pressure water jet mechanism 58 extending from the swivel joint 52 and capable of jetting water under the same high pressure as the first high pressure water jet mechanism 53. The second high pressure water jet mechanism 58 includes a plurality of high pressure water pipes 59 extending from the swivel joint 52 in the radial directions of the top 32, high pressure water passages 60 each extending longitudinally from the end of each high pressure water pipe 59 past the swinging gear 36 and chuck frames 43 of the first chuck mechanism 37, and horizontally directed high pressure water jet nozzles 61 each provided on the lower open end of each high pressure water passage 60.

Thus, the high pressure water from the nozzles 57 is jetted from the center of the bucket 34 toward the outer periphery thereof, and high pressure water from the nozzles 61 is jetted from the outer periphery of the bucket toward the center thereof at the same level as that of the water jetted from the nozzles 57.

The bucket 34 is further provided with a third high pressure water jet unit 62 in addition to the first and second high pressure water jet units 53 and 58. The third high pressure water jet unit 62 includes a plurality of high pressure water passages 63 extending from the swivel joint 52 through and radially of the top 32 and vertically extending through the cylindrical wall 33 and a plurality of high pressure water jet nozzles 64 each provided at the opening of each high pressure water passage 63 at the lower end of the cylindrical wall 33. High pressure water is jetted downwardly from each high pressure water jet nozzle 64.

The method of removing an old and unneeded pile P embedded in the ground by using the old pile removal apparatus 31 will now be described.

Figure 13:
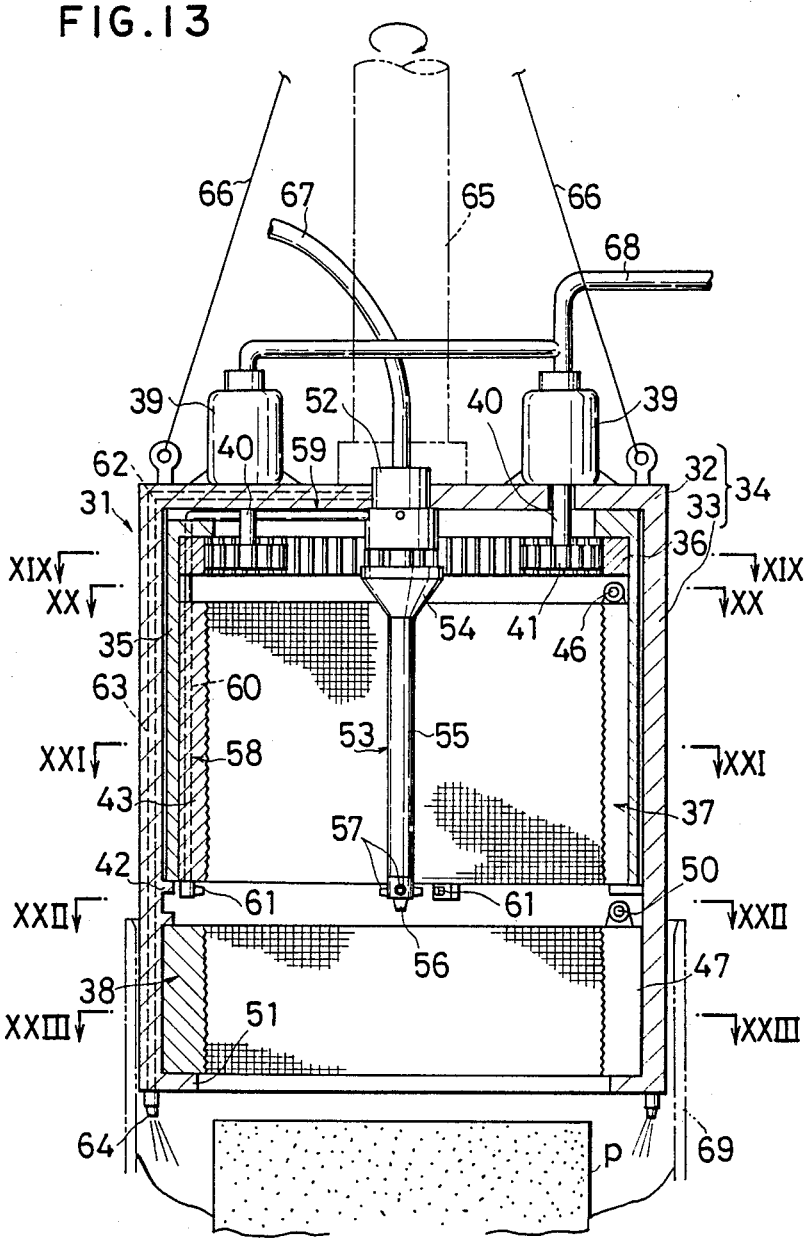
FIG. 13 is a sectional view showing a second embodiment of the apparatus for removing an old pile according to the invention.
Figure 14:
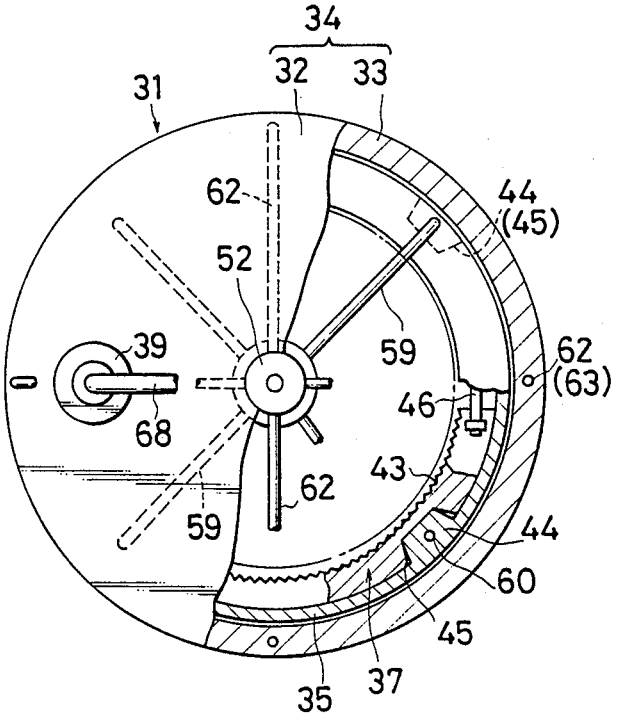
FIG. 14 is a plan view, partly broken away, showing the apparatus shown in FIG. 13.

First, a post 65 of a machine, such as the kelley-bar of an earth drill, is connected to the center of the upper surface of the top 32 of the bucket 34, and the bucket 34 is suspended from a crane (not shown) via wires 66, as shown in FIG. 13. Pressure water hoses 67 are connected at their respective one ends to the high pressure water pipe 55, high pressure water pipes 59 and high pressure water passages 63 of the first, second and third high pressure water jet units 53, 58 and 62 at the swivel joint 52. The other ends of the high pressure water hoses 67 are coupled to an ultra-high pressure water jet unit (not shown) for controlling jet water for each high pressure water jet nozzle of each high pressure water jet unit. An oil pressure hose 68 extending from an oil pressure mechanism (not shown) is connected to the two oil pressure motors 39 and piston-cylinder mechanisms 46 and 50 of the first and second chuck mechanisms 37 and 38.

When the above preparatory operation has been completed, a casing 69 consisting of a metal cylinder is driven into the ground to surround the pile P to remove the earth surrounding the pile. The bucket 34 suspended in air is lowered slowly while turning it in alternately opposite directions at an interval of 180°, for instance, by the post 65. At the same time, high pressure water containing fine abrasive particles is jetted from the high pressure water jet nozzle 56 of the first high pressure water jet unit 53 toward the center of the pile, while downwardly jetting high pressure water from the high pressure water jet nozzles 64 of the third high pressure water jet unit 62. Consequently, an axial bore h is gradually formed in the center of the pile P by the pressure of the high pressure water from the nozzle 56, and the first high pressure water jet unit 53 is gradually inserted into the pile P. At the same time, the earth surrounding the pile P is dug by high pressure water jetted from the high pressure water jet nozzles 64, and the bucket 34 is gradually lowered into the ground. Thus, the bucket 34 is gradually fitted on an upper end portion of the pile P, and the packer 54 is eventually set on the top of the pile P.

Figure 15:
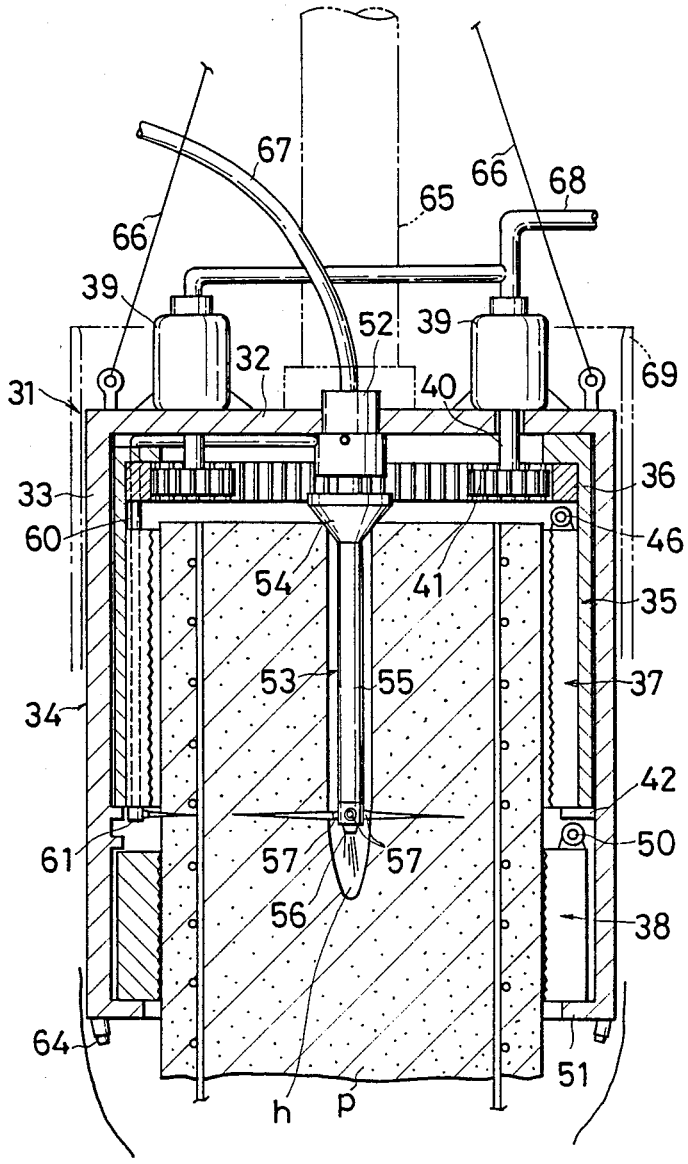
FIG. 15 is a sectional view showing the apparatus of FIG. 13 in a state of cutting an old pile.
Figure 16:
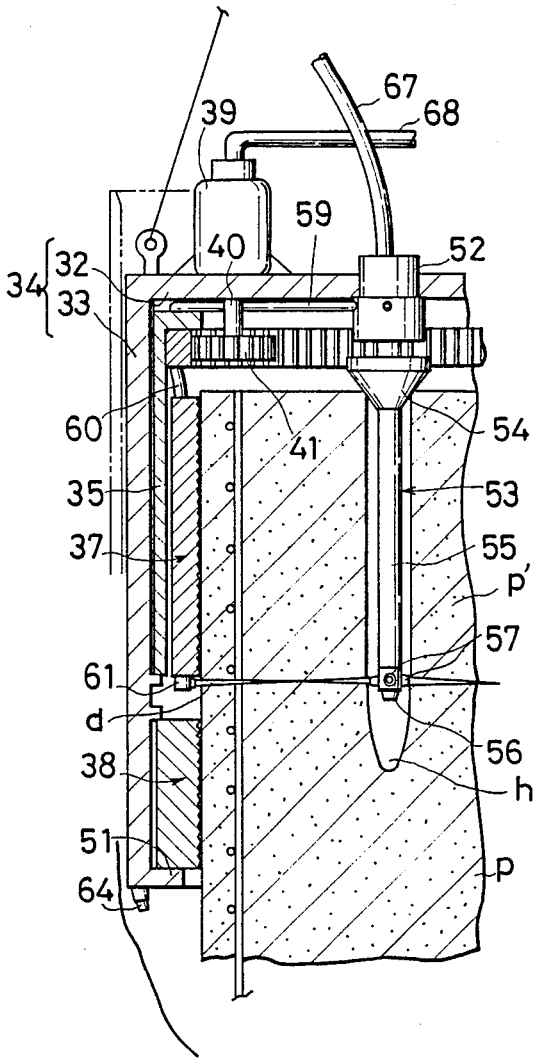
FIG. 16 is a sectional view showing the apparatus with an upper end portion of the old pile severed.
Figure 17:
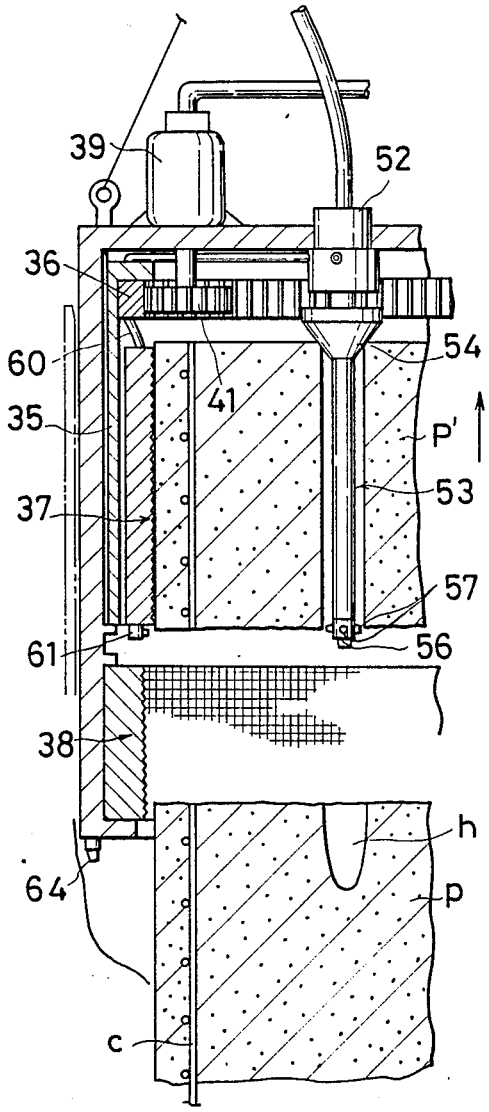
FIG. 17 is a sectional view showing the apparatus in a state of removing the separated pile portion.
Figure 18:
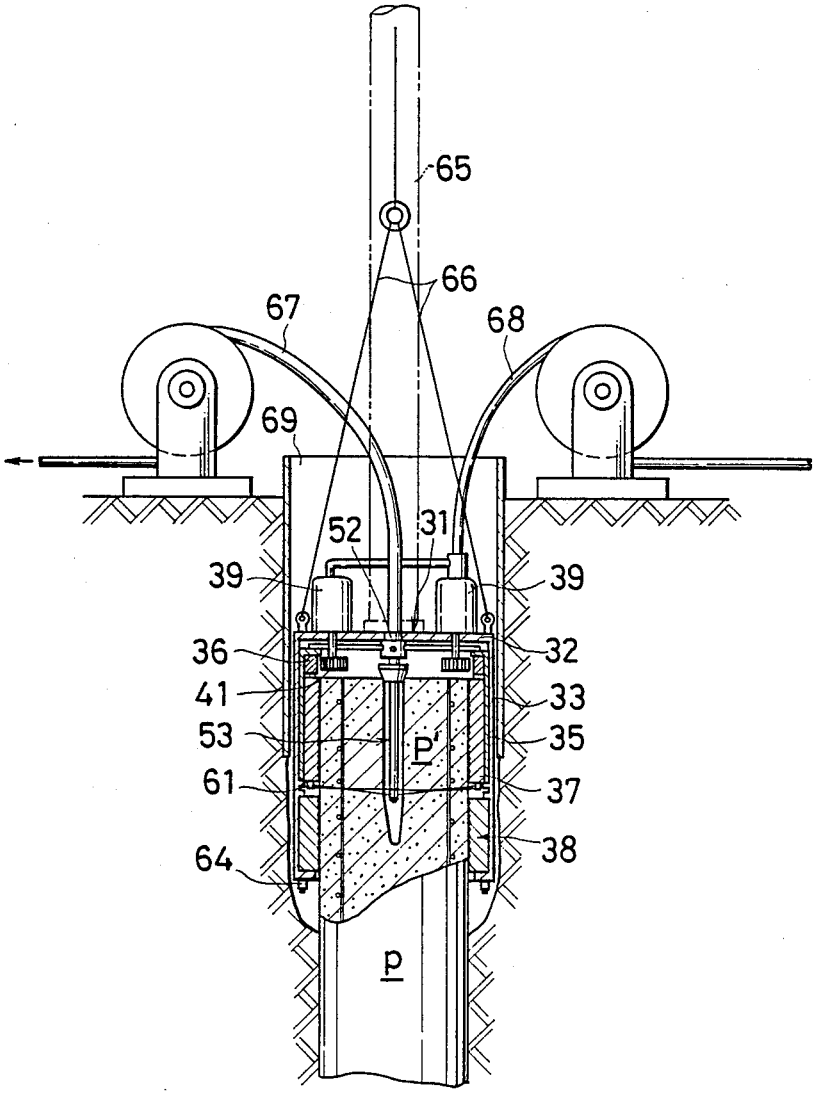
FIG. 18 is a front view, partly in section, showing the apparatus of FIG. 13 set on the top of the old pile.
Figure 19:
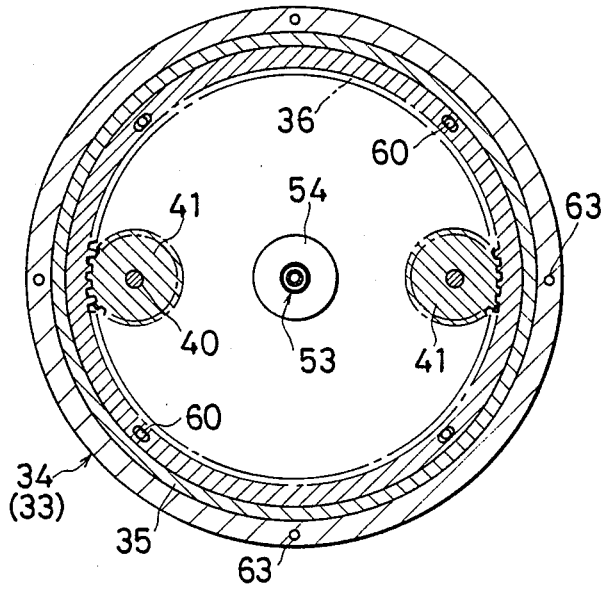
FIG. 19 is a sectional view taken along line XIX—XIX in FIG. 13.

Then, as in the previous embodiment, the jetting of high pressure water from the high pressure water jet nozzles 56 and 64 is stopped, and high pressure water containing fine abrasive particles is jetted horizontally from the high pressure water jet nozzles 57 and 61 of the first and second high pressure water jet nozzles 53 and 58 while turning the bucket 34 in alternately opposite directions at an interval with every rotation by 90° or 180° (FIG. 15). The pile is thus cut from its radial center and opposite sides of the outer periphery at the same level.

If the pile P cannot be sufficiently cut horizontally in the above operation, the pressure in the cut space of the pile P is increased with water as in the previous embodiment, i.e., by sealing the upper end opening of the vertical bore h formed in the center of the pile P with the packer 54 and jetting high pressure water from the high pressure water jet nozzles 56 and 57. In this way, the pile P can be sufficiently cut, radially. When the pile has been sufficiently cut, the jetting of high pressure water from the nozzles is stopped, and the first and second chuck mechanisms 37 and 38 are contracted by forcing operating oil to the piston-cylinder mechanisms 46 and 50 of the first and second chuck mechanisms 37 and 38 to strongly chuck the portion P' of the pile P above the cutting section d of with the first chuck 37 and strongly chuck a portion of the pile P below the cutting section d with the second chuck mechanism 38.

By driving the two oil pressure motors 39 to rotate the swinging gear 36 with the drive gears 41 in this state, the first chuck mechanism 37 is rotated by the swinging gear 36 via the rotary frame 35. Since the second chuck mechanism 38 is not rotated at this time, a stress produced with the rotation of the first chuck mechanism 37 acts on the upper end portion P' of the pile to be received by the second chuck mechanism 38. Thus, the pile portion P' above the cutting section d which still remains integral with the rest of the pile P is severed by twisting.

When the upper end portion P' of the pile has been perfectly separated from the rest of the pile, the rotation of the swinging gear 36 is stopped, and the second chuck mechanism 38 is removed from the pile by supplying operating oil to the piston-cylinder mechanisms 38 to cause expansion of the second chuck mechanism 38. At this time, the bucket 34 is raised with the separated upper end portion P' of the pile held chucked by the first chuck mechanism 37 in the contracted state. In this way, the upper end portion of the pile P can be raised with and removed from the bucket 34.

When the upper end portion of the pile P is removed, the bucket 34 is lowered again to surround a new upper end portion of the pile P, which is then severed and removed in the manner as described above. The above sequence of operations is performed repeatedly to remove the entire length of the pile P from the ground.

Now, a pile removal apparatus with pile hole digging means will be described.

FIGS. 24 to 28 illustrate a third embodiment of the invention applied to a pile removal apparatus, which includes pile hole digging means provided in the pile removal apparatus which is substantially the same as the first embodiment. A first high pressure water jet unit 13 for jetting high pressure water in the downward direction and horizontal directions is provided such that it depends from the inside of a bucket 4 which is open at the bottom and fitted on the top of the pile P. Second high pressure water jet units 21 for jetting high pressure water in the horizontal directions and downward direction are provided at the lower end of the peripheral wall 3 of the bucket 4.

The peripheral wall 3 of the bucket 4 is provided with first chucks 5*a* for chucking the pile P and second chucks 5*b* for urging the inner wall surface of the casing 6. These chucks are accommodated in the peripheral wall 3.

The top 2 of the bucket 4 has an outer flange 2*a*, and the lower end of the peripheral wall 3 of the bucket 4 has an outer flange 3*a*. The inner diameter of the peripheral wall 3 is set to be substantially equal to the outer diameter $D_1$ of the old pile P, and the casing 6 has an outer diameter substantially equal to the diameter $D_2$ of a bore for a pile which is to be newly driven. When the casing 6 is not used, the diameter of the upper and lower flanges 2*a* and 3*a* is set to a value corresponding the diameter $D_2$ of the new pile bore plus the thickness of the casing 6.

Figure 26:
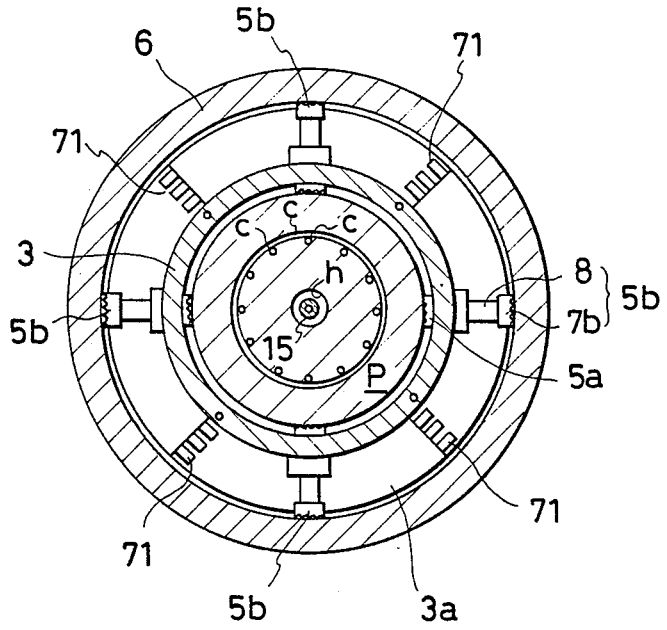
FIG. 26 is a sectional view taken along line XXVI—XXVI in FIG. 25.
Figure 27:
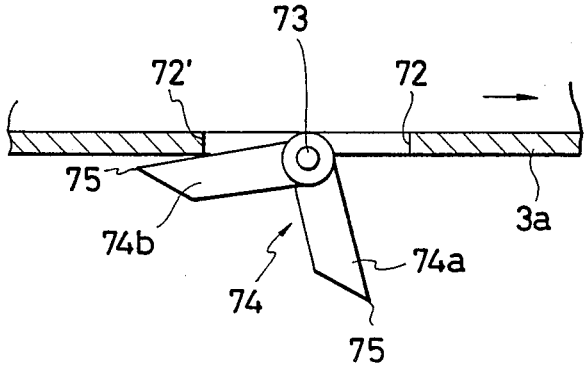
FIG. 27 is a sectional view, to an enlarged scale, showing a digging means of the apparatus shown in FIG. 24.
Figure 28:
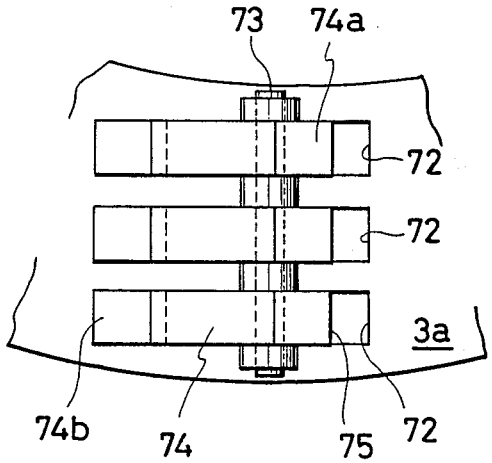
FIG. 28 is a bottom view showing the digging means shown in FIG. 27.

The lower flange 3*a* extending from the lower end of the peripheral wall 3 of the bucket 4 is provided with pile bore digging means 71. As shown in FIGS. 26 to 28, the lower flange 3*a* has a plurality of through holes 72 formed at a suitable angular interval (in this embodiment four through holes being formed at an interval of 90°). Support shafts 73 are provided such that they radially traverse the respective through holes 72. A digging member 74 is rotatably supported on each support shaft 73. The digging member 74 has two wings 74*a* and 74*b* made integral into an L-shaped form and each having a digging edge 75. The wings 74*a* and 74*b* have a length greater than the distance between an edge 72' of the through hole 72 and the support shaft 73, so that the digging member 74 can engage with the lower surface of the lower flange 3*a* adjacent to the through hole 72. In this embodiment, three narrow digging members 74 are provided side by side and in a spaced-apart relation to one another in each through hole 72.

Now, the removal of an old pile and digging of a new pile bore with the pile removal apparatus having the above construction will now be described.

The casing 6 is chucked with the chuck 27 of the setting unit 25 shown in FIGS. 11 and 12 and is brought to surround an upper end portion of the old pile P while being swing by operating the jacks 28 and swinging mechanisms 29. If the casing 6 has the third high pressure water jet unit, high pressure water is jetted downwardly.

When the casing 6 is brought into the ground to a predetermined depth, the earth surrounding the old pile P is removed, and the bucket 4 is suspended in air and lowered into the casing 6 while turning it alternately in opposite directions by the post 30. At the same time, high pressure water containing abrasive particles is jetted downward from the first and second high pressure water jet units 13 and 21, thus forming a vertical bore h in the center of the old pile and also forming an annular groove in the ground facing the bucket 4.

Meanwhile, since the digging means 71 is provided on the lower flange 3*a* of the bucket 4, by turning the bucket 4 the digging means 71 digs the ground surrounding the old pile P to increase the diameter of the pile bore. In the digging of the earth by the digging means 71, with the rotation of the bucket 4 the wing 74*a* front with respect to the rotating direction of the bucket 4 is urged by the earth and rotated rearwardly, and the upper surface of the wing 74*b* rear with respect to the rotating direction of the bucket 4 is upwardly brought into engagement with the edge 72' of the through hole 72. When the bucket 4 is further rotated in this state, since the digging member 74 can no longer be rotated, the digging edge 75 of the wing 74*a* wedges into the ground. With the wedging of the digging member 74 into the ground, the earth is dug up along the upper surface of the wing 74*a*, thus discharging the earth onto the upper surface of the bucket 4 through the front half of the through hole 72. Since at this time the rear half of the through hole 72 is closed by the rear wing 74*b*, the dug earth cannot be returned to the pile bore. When the bucket 4 is inverted, then the digging edge 75 of the wing 74*b* digs the ground, while the wing 74*a* closes the rear half of the through hole 72 to prevent the fall of the earth through the through hole.

As the above sequence of operations is performed repeatedly, the bucket eventually surrounds an upper end portion of the pile P, the packer 14 is set on top of the pile P, and the earth is collected on top of the lower flange 3*a*. The earth that has been collected on the lower flange 3*a* is brought upwardly through the space between the casing 6 and the outer periphery of the peripheral wall 3 of the bucket to be fed through a discharge opening 2*b* formed in the upper flange 2*a* onto the top 2 of the bucket 4.

Then, the downward jetting of high pressure water from the first and second high pressure water jet units 13 and 21 is stopped, and high pressure water containing abrasive particles is jetted from the horizontal jet nozzles 17 and 20 while turning the bucket in alternately opposite directions. In this way, the old pile P is cut horizontally from its center and opposite sides of its outer periphery. When the old pile P is radially cut sufficiently, the jetting of high pressure water from the nozzles 17 and 20 is stopped, and the outer periphery of a portion P' of the old pile P above the cutting section d is strongly chucked with the first chucks 5*a* while securing the bucket 4 to the casing 6 with the second chucks 5*b* by operating the piston-cylinder mechanisms 8. Then, the casing 6 is swung with the setting unit 25 to sever the old pile P at the cutting section d by twisting. The bucket 4 is then raised together with the separated upper end portion P' of the pile, and the earth collected on the upper surface of the bucket 4 is discharged onto the ground surface.

By repeating the above sequence of operations, the old pile is removed progressively from upper portions, and concurrently an increased diameter pile bore for a pile to be newly driven is formed.

Figure 29:
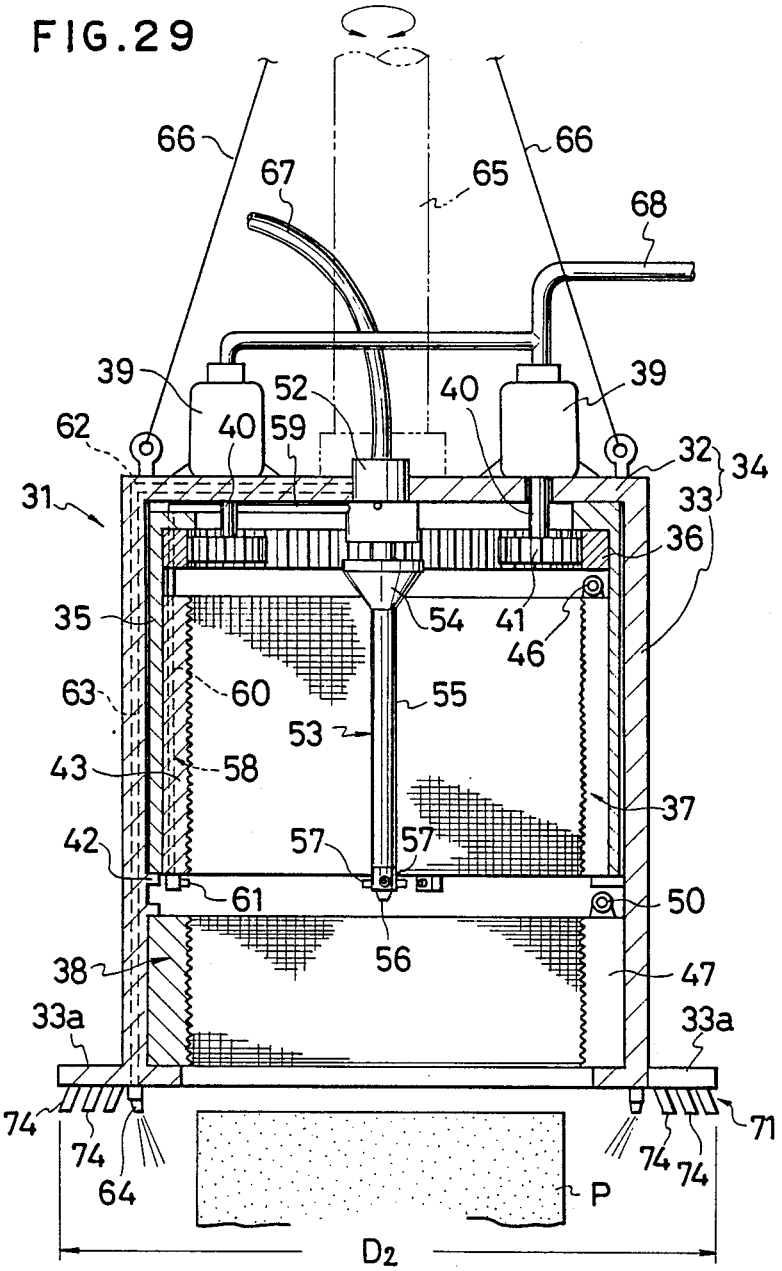
FIG. 29 is a sectional view showing a fourth embodiment of the old pile removal apparatus according to the invention.
Figure 30:
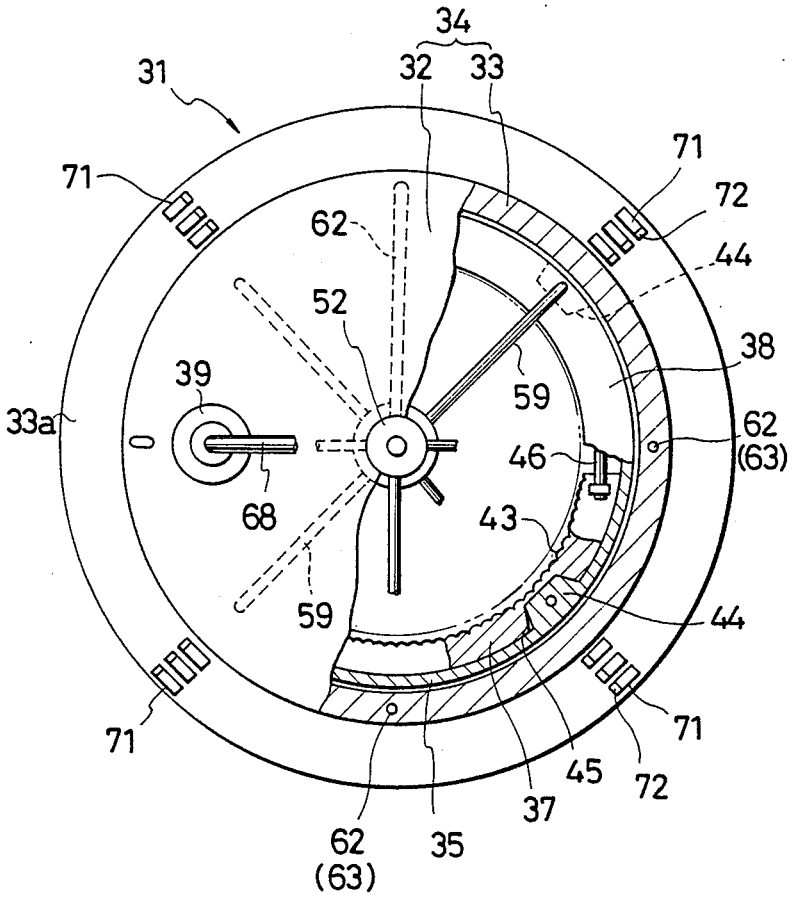
FIG. 30 is a plan view, partly broken away, showing the apparatus shown in FIG. 29.

FIGS. 29 to 30 show a fourth embodiment of the invention. This embodiment has digging means provided in a pile removal apparatus having substantially the same structure as the second embodiment without use of any setting unit. The lower end of the peripheral wall 33 of the bucket 34 has an outer flange 33*a*, and the diameter of the flange 33*a* is set to be substantially the same as the diameter $D_2$ of a new pile.

Like the third embodiment, the flange 33*a* is provided with a plurality of pile bore digging means 71 disposed at predetermined intervals. Each digging means 71, as shown in FIGS. 27 and 28, includes a digging member 74 rotatably supported on a support shaft 73 radially traversing each through hole 72.

The self-turning means, chuck mechanisms and high pressure water jet units provided on the bucket 34 have the some construction as in the second embodiment, and are thus designated by like reference numerals with omission of duplicated description.

For removing an old and unnecessary pile P burried in the ground and also digging a new pile installation bore in the same place by using this embodiment of the pile removal apparatus 31, first the bucket 4 is suspended from a crane (not shown) via wires 66 and lowered to surround the pile P while turning it in alternately opposite directions with the post 65 and downwardly jetting high pressure water. As a result, a vertical bore h is formed in the center of the pile, and the earth surrounding the old pile P is dug by high pressure water and digging means to increase the pile bore diameter. The bucket 34 is brought into the ground to surround an upper end portion of the old pile P.

Then, the pile P is radially cut by horizontally jetting high pressure water from the center and opposite sides of the outer periphery of the pile. Thereafter, the outer periphery of the pile portion P' above the cutting section d is strongly chucked with the first chuck mechanism 37, and a pile portion below the cutting section d is chucked with the second chuck mechanism 38. Then, the first chuck mechanism 37 is turned with the self-turning means to sever the pile P at the cutting section d. Subsequently, the bucket 4 is raised to remove the separated upper end portion P' of the pile together with the earth on the flange 33*a* and on the top 32 of the bucket 34.

When the upper end portion P' of the pile P has been removed, sequence of operations as described above is repeatedly performed, thus removing the entire length of the old pile and forming an increased diameter pile bore for the installation of a new pile in the same place.

FIG. 31 shows a further embodiment of the invention. In this instance, the earth produced as the ground is dug by digging means 71 provided on the bucket 4 is not collected on the top 2 of the bucket 4, but it is immediately discharged on the ground by a sand pump or an air lifter (not shown). Thus, in this embodiment the top 2 has the same diameter as the outer periphery 3, and a mud-lifting pipe 76 extends above the flange 3*a*.

In this embodiment, earth is not collected on the bucket 4, so that it is possible to perform quick operation and reduce the time consumption. Further, the structure of the bucket 4 can be simplified.

Not only the Benoto process using a case, but also the earth drill process and reverse circulation process which do not use any casing are applicable to this embodiment.

While the method and apparatus according to the invention have been described in conjunction with the illustrated embodiments, these embodiments are by no means limitative and can be modified variously without departing from the scope of the invention.

As has been described in the foregoing, according to the invention a rotatable bucket is set to surround an upper end portion of an old pile burried in the ground, the ground surrounding the pile is dug to increase the pile bore diameter if necessary, and an upper end portion of the pile is radially severed by jetting high pressure water and also twisting it. Thus, an old pile can be removed readily, efficiently and progressively from upper portions by operations conducted on the ground. Besides, the pile bore diameter can be simultaneously increased. Thus, there is no need of newly digging a new pile bore for installing a new pile. Thus, the construction work can be simplified, and the time consumption for the work can be reduced. Further, since the old pile can be severed with jetted water, there is no possibility of noise and vibration problems, and the removal of an old pipe and formation of a new pile bore for installing a new pile can be attained simultaneously even in residential quarters or urban areas. It is thus possible to effectively utilize the land and construct a building structure as designed, so that the invention is of utility value.

What is claimed is:

1. A method of removing an old pile comprising the steps of setting a casing to surround an upper end portion of the old pile embedded in the ground with a setting unit, setting a pile removal apparatus including a bucket capable of rotation in said casing and a chuck mechanism capable of being secured to said old pile so as to surround said pile upper end portion, radially substantially cutting a portion of said old pile with water jetted from said pile removal apparatus, chucking a portion of said old pile above said cut portion to said bucket with said chuck mechanism, securing said casing and bucket to each other, severing said pile portion above said cut portion by stress produced by causing swinging of said casing with said setting unit and removing said separated pile portion by raising said pile removal apparatus.

2. A method of removing an old pile comprising the steps of setting a bucket including a first chuck mechanism capable of rotation and a second chuck mechanism incapable of rotation such as to surround an upper end portion of an old pile burried in the ground, radially substantially cutting a portion of said old pile between said first and second chuck mechanisms with water jetted from said bucket, chucking a portion of said old pile above said cut portion with said first chuck mechanism, chucking a portion of said old pile below said cut portion with said second chuck mechanism, severing said pile upper end portion above said cut portion by turning said first chuck mechanism and receiving the resultant stress with said second chuck mechanism, and raising and removing the severed pile upper end portion.

3. A method of removing an old pile comprising the steps of setting a bucket capable of being chucked with a chuck mechanism to surround an upper end portion of an old pile burried in the ground, radially cutting a portion of said old pile with water jetted from said bucket, chucking a portion of said old pile above said cut portion to said bucket with said chuck mechanism, severing said pile portion above said cut portion by turning said bucket and receiving the resultant stress with a pile portion below said cut portion, digging the ground surrounding said old pile with digging means provided at the lower end of said bucket, removing said severed upper end portion of said pile by raising it together with said bucket while at the same time increasing the diameter of a pile bore.

4. An apparatus for removing an old pile comprising a casing open at the top and bottom and to be set to surround an upper end portion of the old pile, a bucket rotatably supported in said casing, a first high pressure water jet unit depending from and extending through the center of said bucket for jetting high pressure water in the downward and horizontal directions, and a second high pressure water jet unit provided on a lower portion of said bucket and jetting high pressure water toward the center of said bucket, said old pile being radially cut by high pressure water from said first and second high pressure water jet units.

5. An apparatus for removing an old pile comprising a bucket open at the bottom and to be set to surround an upper end portion of the old pile, said bucket being provided with a first chuck mechanism capable of rotation and a second chuck mechanism incapable of rotation, a first high pressure water jet unit depending from the top of said bucket for jetting high pressure water in the downward and horizontal directions, and a second high pressure water jet unit provided in said bucket between said first and second chuck mechanisms for jetting water in the horizontal direction, said old pile being radially cut by hig pressure water jetted from said first and second high pressure water jet units.

6. An apparatus for removing an old pile according to claim 4, wherein said bucket has an outer flange provided at the lower end, and digging means for digging the earth surrounding said old pile is provided on said outer flange.

7. The apparatus for removing an old pile according to claim 5, wherein said bucket has an outer flange provided at the lower end, and digging means for digging the earth surrounding said old pile is provided on said outer flange.

* * * * *